US012194334B1

(12) United States Patent
Lv

(10) Patent No.: US 12,194,334 B1
(45) Date of Patent: Jan. 14, 2025

(54) HOOK-SHAPED ANGLE-ADJUSTABLE FITNESS HANDLE

(71) Applicant: Zejie Lv, Yongkang (CN)

(72) Inventor: Zejie Lv, Yongkang (CN)

( * ) Notice: Subject to any disclaimer, the term of this patent is extended or adjusted under 35 U.S.C. 154(b) by 0 days.

(21) Appl. No.: 18/675,083

(22) Filed: May 27, 2024

(30) Foreign Application Priority Data

Feb. 20, 2024 (CN) ..... 202420314661.0

(51) Int. Cl.
*A63B 21/00* (2006.01)

(52) U.S. Cl.
CPC ..... *A63B 21/4035* (2015.10); *A63B 2225/09* (2013.01)

(58) Field of Classification Search
CPC ..... A63B 21/4035; A63B 21/4047; A63B 21/4049; A63B 2225/09; A63B 2244/09
See application file for complete search history.

(56) References Cited

U.S. PATENT DOCUMENTS 5,429,571 A * 7/1995 Smith ..... A63B 23/1209 482/904
6,692,416 B1 * 2/2004 Davis ..... A63B 21/4035 482/44
7,473,213 B1 * 1/2009 Kallenbach ..... A63B 21/4017 16/428
8,360,941 B2 * 1/2013 Kristiansen ..... A63B 21/4017 482/139
10,695,601 B2 * 6/2020 Souffrain ..... A63B 1/00
10,695,609 B2 * 6/2020 Anastasi ..... A63B 21/068
2009/0111661 A1 * 4/2009 Hauser ..... A63B 23/1209 482/40
2009/0203508 A1 * 8/2009 Hauser ..... A63B 21/4049 482/139
2011/0218085 A1 * 9/2011 Kristiansen ..... A63B 23/1218 482/139
2016/0303419 A1 * 10/2016 Karpachevskyy ..... A63B 21/4035
2023/0249023 A1 * 8/2023 Kim ..... A63B 23/03525 482/92
2023/0302323 A1 * 9/2023 Sasano ..... A63B 21/4035
2024/0189662 A1 * 6/2024 Kachlany ..... A63B 23/14

FOREIGN PATENT DOCUMENTS

AT 522025 A1 * 7/2020
FR 2605232 A1 * 4/1988
KR 20210051665 A * 5/2021
KR 20230075863 A * 5/2023

* cited by examiner

*Primary Examiner* — Gary D Urbiel Goldner

(57) ABSTRACT

A hook-shaped angle-adjustable fitness handle, including a handle body. The handle body includes a hook-shaped frame and a grip frame, enabling a user to hang the fitness handle on a fitness equipment for use through the hook-shaped frame; the hook-shaped frame is rotatably connected to the grip frame, and a limiting member is arranged at a connection position of the hook-shaped frame and the grip frame.

5 Claims, 5 Drawing Sheets

HOOK-SHAPED ANGLE-ADJUSTABLE FITNESS HANDLE

CROSS REFERENCE

The present disclosure claims priority of Chinese Patent Application No. 202420314661.0, filed on Feb. 20, 2024, the entire contents of which are hereby incorporated by reference in their entirety.

TECHNICAL FIELD

The present disclosure relates to the technical field of fitness equipment, and especially relates to a hook-shaped angle-adjustable fitness handle.

BACKGROUND

In the field of fitness and physical activity, the use of handles for a variety of suspension or tension training is a widely practiced way to build muscle strength, endurance, and improve overall body coordination. However, a conventional fitness handle usually has a fixed shape and angle, limiting the user's range of motion and postural variations during training, which reduces the variety of training and may sometimes lead to excessive joint stress or overstretching due to improper angles, thereby increasing the risk of injury.

In response to these problems, some adjustable fitness handles have been introduced in the market, which can be adapted to individual needs of different users to a certain extent. However, the existing adjustable handles provide only limited angle adjustment options, or the adjustment mechanism is complex and not intuitive enough for users to adjust the angle quickly and easily during different training phases.

Therefore, it has become an important direction of technological development in this field to provide of a fitness handle which has a simple structure, an easy adjustment capability, and the ability to provide a wider range of angle options, for adapting to more diverse training needs and effectively reducing the potential risk of injury during training.

SUMMARY OF THE DISCLOSURE

To solve the above problems mentioned in the Background, the present disclosure provides a hook-shaped angle-adjustable fitness handle, and the user can make simple and quick adjustments according to his/her own needs, which may be adapted to a more diverse range of training needs and effectively avoid the discomfort and injuries brought about by restricted joints, thereby minimizing the risk of potential injuries during training.

To solve the above technical problem, the present disclosure provides a hook-shaped angle-adjustable fitness handle, including a handle body; wherein the handle body includes a hook-shaped frame and a grip frame; the hook frame is rotatably connected to the grip frame, and a limiting member is arranged at a connection position of the hook-shaped frame and the grip frame.

In some embodiments, the hook-shaped frame includes a hook portion and a connection portion connected to a bottom end of the hook portion; the grip frame is rotatably connected to the connection portion.

In some embodiments, the grip frame includes a frame body of an inverted "U"-shaped structure and a handle bar connected between two free ends of the frame body; the frame body is rotatably connected to the connection portion.

In some embodiments, a connection hole is defined on each of an end surface of the connection portion and an end surface of the frame body, the end surface of the connection portion and the end surface of the frame body being connected and mated with each other; a rotation bolt is arranged in the connection hole for connecting the connection portion and the frame body.

In some embodiments, a plurality of angle adjustment holes are equally spaced along a periphery of the connection hole on the end surface of the connection portion, and a limiting hole is defined on the end surface of the frame body, the limiting hole being capable of corresponding to and facing each of the plurality of angle adjustment holes; the limiting member is configured to be passed through the limiting hole and inserted into a corresponding angle adjustment hole.

In some embodiments, the limiting member includes a limiting column and an adjustment ring connected to the limiting column, and the limiting column is configured to be inserted into the limiting hole and the corresponding angle adjustment hole.

In some embodiments, an anti-slip sleeve is sleeved on the hook portion.

In summary, the beneficial effects of the present disclosure are the following.

1. In the present disclosure, the fitness handle includes a hook-shaped frame and a grip frame, enabling the user to hang the fitness handle on a fitness equipment such as lever or barbell for use through the hook-shaped frame, which enriches the user's training program and has a wide scope of application.

2. In addition, the grip frame is rotatably connected to the hook-shaped frame, which provides a wide range of angle adjustments, such that the user can adjust the angle according to his/her training needs or physical conditions, which may effectively reduce the joint pressure or overstretching due to the fixed angle, thereby reducing the risk of injury. Further, the limiting member makes the angle adjustments quicker and simpler, which saves the time of adjustments and improves the training efficiency.

The above description is only an overview of the technical program of the present disclosure. To enable those skilled in the art to more clearly understand the technical means of the present disclosure and implement the same in accordance with the contents of the specification, and to make the above and other purposes, features, and advantages of the present disclosure more obvious and easier to understand, the following is a detailed description of some embodiments of the present disclosure in conjunction with the accompanying drawings.

Figure 1:
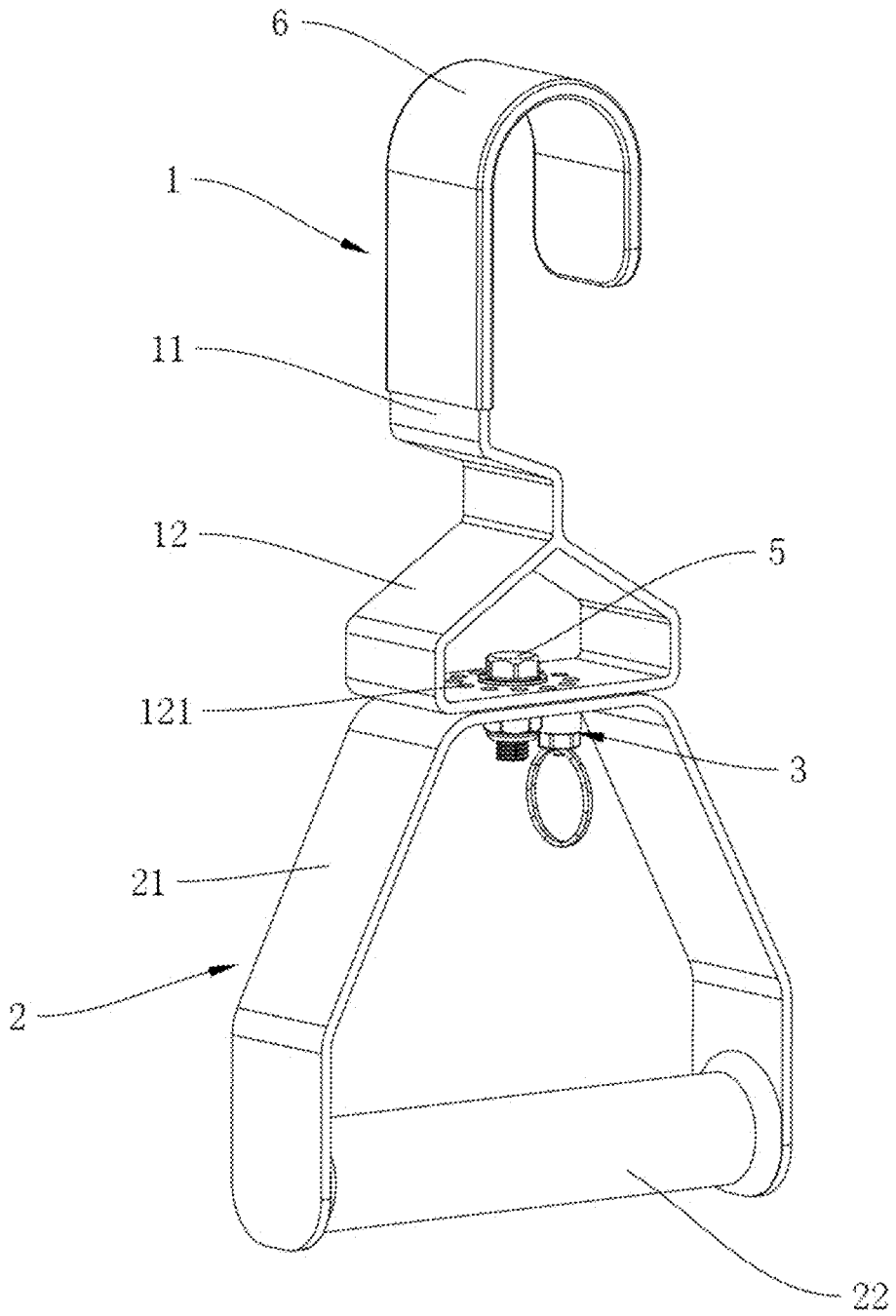
FIG. 1 is a structural schematic view according to the present disclosure.

Reference numerals: 1, hook-shaped frame; 11, hook portion; 12, connection portion; 121, angle adjustment hole;

2, grip frame; 21, frame body; 211, limiting hole; 22, handle bar; 3, limiting member; 31, limiting column; 32, adjustment ring; 4, connection hole; 5, rotation bolt; 6, anti-slip sleeve.

DETAILED DESCRIPTION

To make the contents of the present disclosure more easily and clearly understood, the following is a further description of the present disclosure according to specific embodiments and in conjunction with the accompanying drawings.

It should be noted that the terms of "center", "top", "bottom", "front", "back", "left", "right", "inside" and "outside", etc. in the present disclosure indicate orientations or positional relationships based on those shown in the accompanying drawings, and are only intended to facilitate the description of the present disclosure and to simplify the description, but not intended to indicate or imply that a device or element referred to must have a particular orientation, be constructed and operated with a particular orientation, and therefore are not to be construed as a limitation of the present disclosure. Unless otherwise specified, the terms of "plurality" mean two or more.

Unless otherwise expressly provided and limited, the terms of "mounted", "connected", "coupled" are to be understood in a broad sense, for example, they may be fixed connection, removable connection, or integral connection; they may be mechanical connection or electrical connection; they may be direct connection or indirect connection through an intermediate medium, or connection within two elements. For those skilled in the art, the specific meaning of the above terms in the present disclosure may be understood by the specific circumstances.

Figure 2:
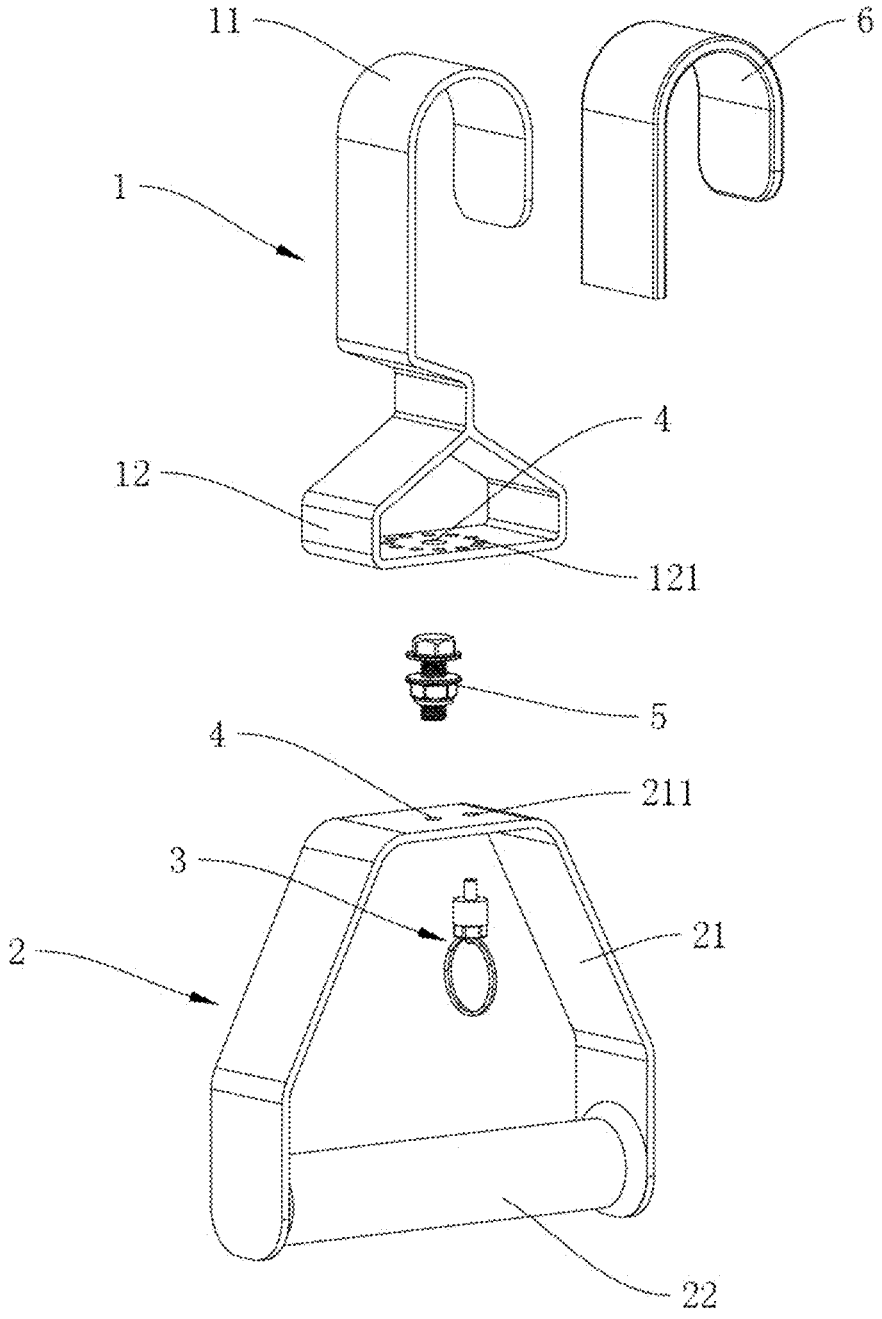
FIG. 2 is a dissembled schematic view according to the present disclosure.

As shown in FIGS. 1 and 2, a hook-shaped angle-adjustable fitness handle includes a handle body. A user may hang the handle body on a fitness equipment for use, to improve fitness effect and reduce the risk of injury. The handle body includes a hook-shaped frame 1 and a grip frame 2, where the hook-shaped frame 1 is configured to hang on the fitness equipment (e.g., a lever, a barbell, etc.), and the grip frame 2 is configured for the user to hold for fitness; the hook frame 1 is rotatably connected to the grip frame 2, and a posture and an angle of the user's hand holding the hand grip can be adjusted by rotating the grip frame 2, which facilitates the user to adjust an appropriate training angle according to his/her training needs or physical conditions, thereby effectively reducing the pressure on the joints or overstretching brought about by a fixed angle, and thus reducing the risk of injury.

A limiting member 3 is arranged at a connection position of the hook-shaped frame 1 and the grip frame 2, such that when the user adjusts the grip frame 2 to the appropriate angle, an angle between the grip frame 2 and the hook-shaped frame 1 can be limited by the limiting member 3. In this way, injuries caused by the rotation of the grip frame 2 during usage may be prevented. In addition, the limiting member 3 limits the angle in a fast and simple way, which saves the user's time for adjusting, thereby improving the training efficiency.

Figure 3:
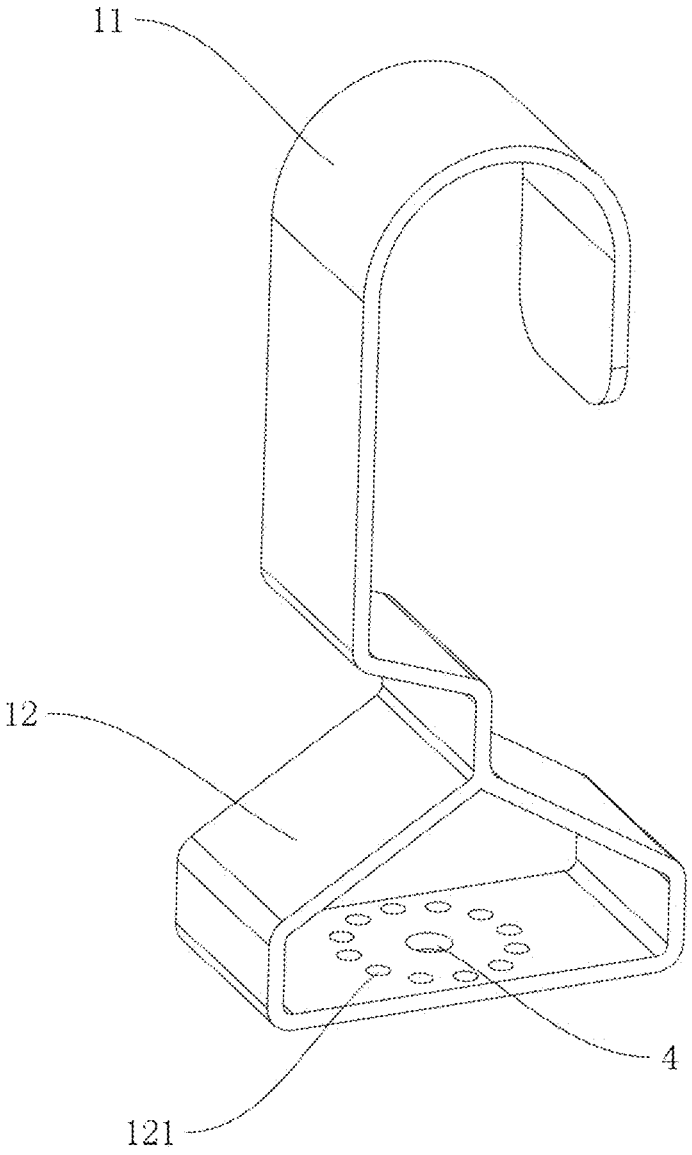
FIG. 3 is a structural schematic view of a hook-shaped frame according to the present disclosure.

Specifically, as shown in FIG. 3, the hook-shaped frame 1 includes a hook portion 11 and a connection portion 12 connected to a bottom end of the hook portion 11, where the hook portion 11 is configured to hang on the fitness equipment, and the connection portion 12 is configured to be connected to the grip frame 2 to realize the adjustable angle of the grip frame 2.

Figure 4:
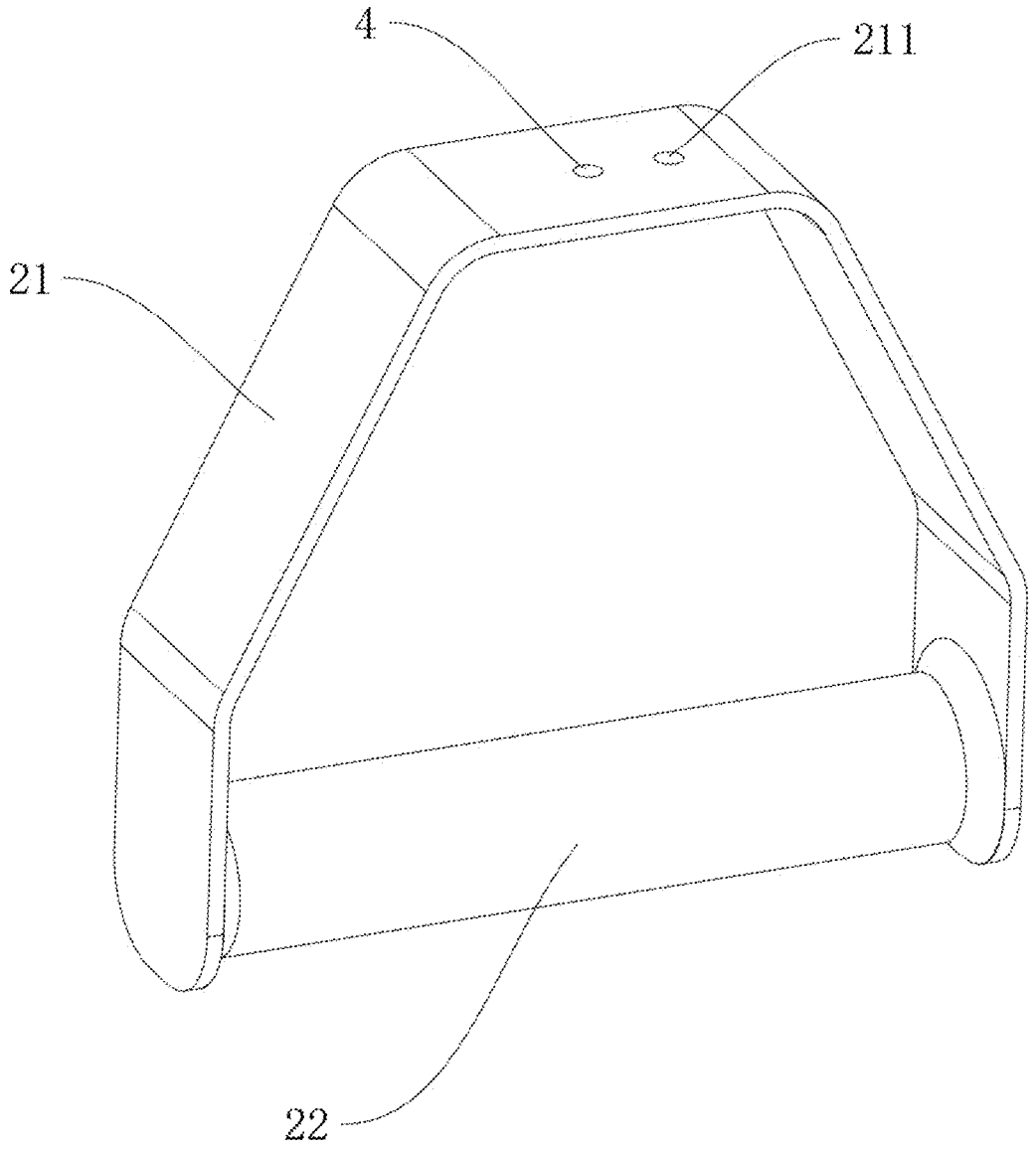
FIG. 4 is a structural schematic view of a grip frame according to the present disclosure.

As shown in FIG. 4, the grip frame 2 includes a frame body 21 of an inverted "U"-shaped structure and a handle bar 22 connected between two free ends of the frame body 21. By arranging the frame body 21 into the inverted "U"-shaped structure, the handle 22 can be at the center of gravity of the grip frame 2, which may avoid injuries due to the shift of the center of gravity during usage; a top of the frame body 21 is rotatably connected to the connection portion 12, thereby realizing the adjustable angle between the hook-shaped frame 1 and the grip frame 2.

As shown in FIGS. 2 to 4, a connection hole 4 is defined on each of an end surface of the connection portion 12 and an end surface of the frame body 21, where the end surface of the connection portion 12 and the end surface of the frame body 21 are to be connected and mated with each other; a rotation bolt 5 is arranged in the connection hole 4, such that the grip frame 2 and the hook-shaped frame 1 can be connected through the rotation bolt 5 through the connection hole 4, which is a convenient and stable connection way. Further, the strength of the rotation between the grip frame 2 and the hook-shaped frame 1 can be adjusted by loosening and tightening the rotation bolt 5.

To limit the adjusted angle, multiple angle adjustment holes 121 are equally spaced along a periphery of the connection hole 4 on the end surface of the connection portion 12, and a limiting hole 211, that can correspond to and face each of the multiple angle adjustment holes 121, is defined on the end surface of the frame body 21. After the angle between the grip frame 2 and the hook-shaped frame 1 has been adjusted, the limiting member 3 may be passed through the limiting hole 211 and inserted into a corresponding angle adjustment hole corresponding to the angle between the grip frame 2 and the hook-shaped frame 1, such that the restriction of the rotation angle of the grip frame 2 can be realized, and the adjustment method is fast and convenient.

In other embodiments, the setting positions of the angle adjustment holes 121 and the limiting holes 211 are interchanged, i.e., the angle adjustment holes 121 are defined on the end surface of the frame body 21, and the limiting hole 211 is defined on the end surface of the connection portion 12, which can also obtain the same technical effect and will not be repeated herein.

Figure 5:
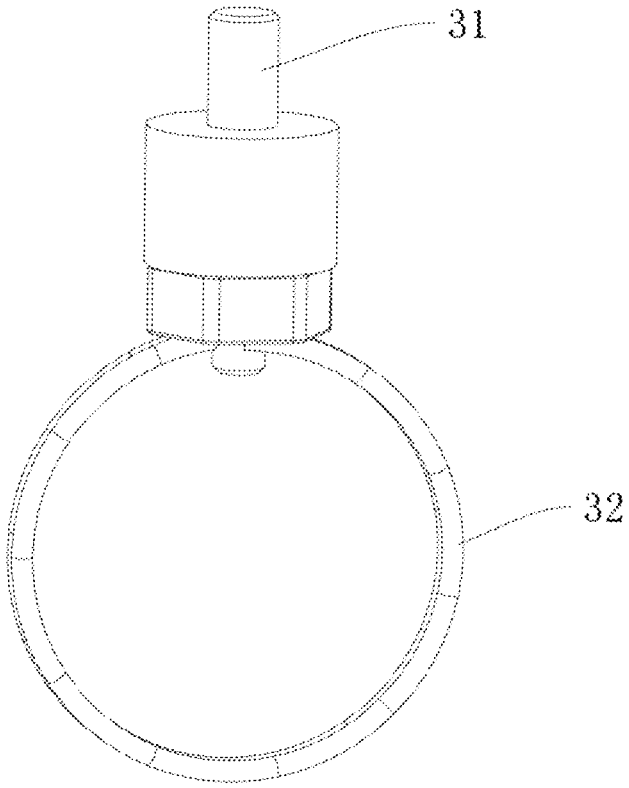
FIG. 5 is a structural schematic view of a limiting member according to the present disclosure.

As shown in FIG. 5, the limiting member 3 includes a limiting column 31 and an adjustment ring 32, and the way of the limiting member 3 limiting the angle between the grip frame 2 and the hook-shaped frame 1 can be inserting the limiting column 31 in the limiting hole 211 and the corresponding angle adjustment hole 121; the adjustment ring 32 is connected to a bottom end of the limiting column 31, and the user can plug or unplug the limiting column 31 by means of the adjustment ring 32 to facilitate the user to adjust the angle between the grip frame 2 and the hook-shaped frame 1.

As shown in FIG. 2, an anti-slip sleeve 6 is sleeved on the hook portion 11, and the anti-slip sleeve 6 is made of plastic, which may reduce the wear and tear of the hook-shaped frame 1 when it is hanged and used on the fitness equipment, thereby increasing the friction force to avoid slipping and injuries during usage.

In the present disclosure, the fitness handle includes a hook-shaped frame 1 and a grip frame 2, enabling the user to hang the fitness handle on a fitness equipment such as lever or barbell for use through the hook-shaped frame 1, which enriches the user's training program and has a wide scope of application. In addition, the grip frame 2 is rotatably connected to the hook-shaped frame 1, which provides a wide range of angle adjustments, such that the user can adjust the angle according to his/her training needs or physical conditions, which may effectively reduce the joint pressure or overstretching due to the fixed angle, thereby reducing the risk of injury. Further, the limiting member 3 makes the angle adjustments quicker and simpler, which saves the time of adjustments and improves the training efficiency.

The above-mentioned embodiments are only some embodiments of the present disclosure, and cannot be considered to limit the scope of the present disclosure. Any non-substantive changes and modifications made by the those skilled in the art based on the present disclosure belong to the scope of the present disclosure.

What is claimed is:

1. A hook-shaped angle-adjustable fitness handle, comprising a handle body; wherein the handle body comprises a hook-shaped frame (1) and a grip frame (2); the hook-shaped frame (1) is rotatably connected to the grip frame (2), and a limiting member (3) is arranged at a connection position of the hook-shaped frame (1) and the grip frame (2);

wherein the hook-shaped frame (1) comprises a connection portion (12), the grip frame (2) comprises a frame body (21); a connection hole (4) is defined on each of an end surface of the connection portion (12) and an end surface of the frame body (21), the end surface of the connection portion (12) and the end surface of the frame body (21) being connected and mated with each other;

a plurality of angle adjustment holes (121) are equally spaced along a periphery of the connection hole (4) on one of the end surface of the connection portion (12) and the end surface of the frame body (21), and a limiting hole (211) is defined on an other one of the end surface of the connection portion (12) and the end surface of the frame body (21), the limiting hole (211) being capable of corresponding to and facing each of the plurality of angle adjustment holes (121);

the limiting member (3) comprises a limiting column (31) and an adjustment ring (32) connected to a bottom end of the limiting column (31), and the limiting column (31) is configured to be inserted into the limiting hole (211) and the corresponding angle adjustment hole (121) by the adjustment ring (32).

2. The hook-shaped angle-adjustable fitness handle according to claim 1, wherein the hook-shaped frame (1) comprises a hook portion (11), and the connection portion (12) is connected to a bottom end of the hook portion (11); the grip frame (2) is rotatably connected to the connection portion (12).

3. The hook-shaped angle-adjustable fitness handle according to claim 2, wherein the frame body (21) is an inverted "U"-shaped structure and the grip frame (2) comprises a handle bar (22) connected between two free ends of the frame body (21); the frame body (21) is rotatably connected to the connection portion (12).

4. The hook-shaped angle-adjustable fitness handle according to claim 3, wherein a rotation bolt (5) is arranged in the connection holes (4) for connecting the connection portion (12) and the frame body (21).

5. The hook-shaped angle-adjustable fitness handle according to claim 2, wherein an anti-slip sleeve (6) is sleeved on the hook portion (11).

* * * * *